United States Patent [19]

Pozzobon

[11] Patent Number: 4,700,496

[45] Date of Patent: Oct. 20, 1987

[54] BOOT, IN PARTICULAR SKI BOOT, WITH A MONOLITHIC STRUCTURE

[75] Inventor: Alessandro Pozzobon, Treviso, Italy

[73] Assignee: NORDICA S.p.A., Montebelluna TV, Italy

[21] Appl. No.: 872,330

[22] Filed: Jun. 9, 1986

[30] Foreign Application Priority Data

Jun. 13, 1985 [IT] Italy ..... 21146 A/85

[51] Int. Cl.[4] ..... A43B 5/04; A43C 11/00

[52] U.S. Cl. ..... 36/117; 36/50; 24/68 SK

[58] Field of Search ..... 36/117–121, 36/54, 50; 24/68 SK

[56] References Cited

U.S. PATENT DOCUMENTS

| | | | |
|---|---|---|---|
| 4,406,073 | 9/1983 | Spademan | 36/119 |
| 4,539,763 | 9/1985 | Walkhoff | 36/120 |
| 4,561,196 | 12/1985 | Petrini et al. | 36/118 |

FOREIGN PATENT DOCUMENTS

| | | | |
|---|---|---|---|
| 0053340 | 6/1982 | European Pat. Off. | 36/117 |
| 0074513 | 3/1983 | European Pat. Off. | 36/121 |
| 3524792 | 1/1986 | Fed. Rep. of Germany | 36/117 |

*Primary Examiner*—James Kee Chi

*Attorney, Agent, or Firm*—Guido Modiano; Albert Josif

[57] ABSTRACT

The ski boot comprises a body which defines enbloc the base shell and the front quarter, said body being pivotably connected to a rear quarter. Inside the body an internal quarter is provided, which is associated at its lower end to said body and occupies the front part of the leg, and, if required, also occupies the forward top part of the foot, as well as lateral parts of the leg and foot. Furthermore, closing means are provided, which means are rigidly connected to the internal quarter, and are connected to the front quarter defined by the body and the rear quarter for securing the leg of the user.

10 Claims, 7 Drawing Figures

BOOT, IN PARTICULAR SKI BOOT, WITH A MONOLITHIC STRUCTURE

BACKGROUND OF THE INVENTION

The present invention relates to a boot, in particular a ski boot, with a monolithic structure.

As known, ski boots are generally composed of a shell to which a front quarter and a rear quarter are pivotably connected, which, by a variety of closing means, are secured to a skier's leg.

With the solutions of the prior art, it turns out that in order to obtain a certain stiffness of the boot, especially when using the edges of the ski to brake or turn, when the boot is stressed laterally, it is necessary to use relatively high thicknesses in the manufacture of the components of the boot.

Another disadvantage which is found in prior art boots is represented by the fact that remarkable problems are encountered in avoiding bulging of the boot in the heel parts, which disadvantage is further increased by the fact that presently only one closing lever is provided between the quarters.

Still another disadvantage is represented by the fact that the foot is not restrained in a stable way within the boot, since by rotating the front quarter on the shell, the quarter detaches from shell, thereby leaving an empty space, with the consequent necessity of carrying out the securing of the foot by means of foot securing mechanisms with a 45 degrees locking.

Still another disadvantage which can be found in the prior art is represented by the fact that, in order to perform the securing of the boot, it is necessary to perform a remarkable effort since, besides the strictly necessary effort required to perform the securing of the quarters, it is also necessary to overcome the resistance due to the frictions related to the movement of the quarter on the shell, as well as those due to the antagonism of the various elements which are tightened simultaneously.

SUMMARY OF THE INVENTION

The aim of this invention is thus to eliminate the previously described disadvantage by providing a ski boot with a monolithic structure, which allows the attainment of a remarkable lateral stiffness of the boot, though allowing for a reduction in the overall weight of the boot, which is mostly determined by the reduction of the necessary thickness.

Within the scope of the above described aim, a particular object of the invention is to provide a ski boot in which bulging of the heel zone is prevented, since the monolithic structure adopted does not leave the possibility of bulging in said zone.

Still another object of the present invention is to produce a ski boot in which a stiff securing of a foot can be performed, since said boot does not have the conventional shift of the front quarter with respect to the shell.

A not least object of the present invention is to provide a ski boot wherein the securing of the quarters to the leg can be performed with a small effort, since frictions and antagonisms of the various accessories provided in the boor need not be overcome.

The above aim as well as the objects referred to and others which will become apparent hereinafter are achieved by a boot, particularly a ski boot, with a monolithic structure, which comprises a body defining enbloc the shell and the front quarter, to said body, a rear quarter being pivotably connected, which boot is characterized in that it comprises, within said body, an internal quarter, associated, at its lower end, with said body and occupying at least the front part of the leg, there also being provided locking means which act between said internal quarter and said rear quarter and interact with the front quarter defined by said body in order to preset the tilt of said internal quarter relatively to said front quarter.

BRIEF DESCRIPTION OF THE DRAWINGS

Further features and advantages will be more evident from the description of a preferred, though not limitative, embodiment of a boot, in particular a ski boot, with a monolithic structure, which is illustrated by way of example only in the accompanying drawings, where.

DESCRIPTION OF A PREFERRED EMBODIMENT

Figure 1:
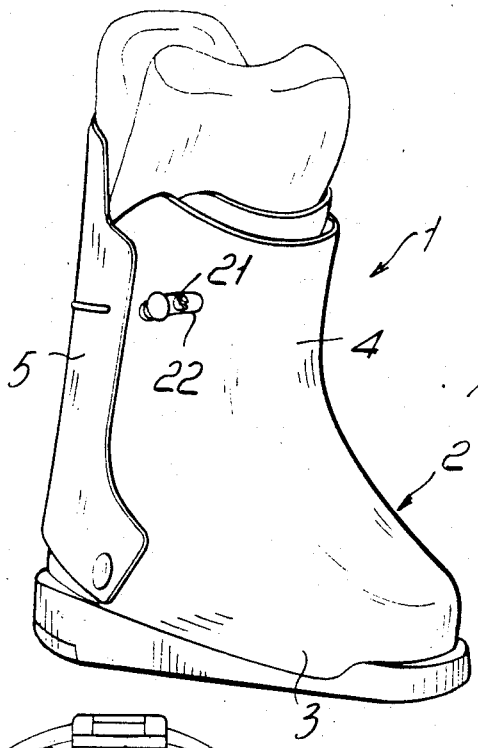
FIG. 1 is a schematic perspective view of the ski boot according to the invention.
Figure 4:
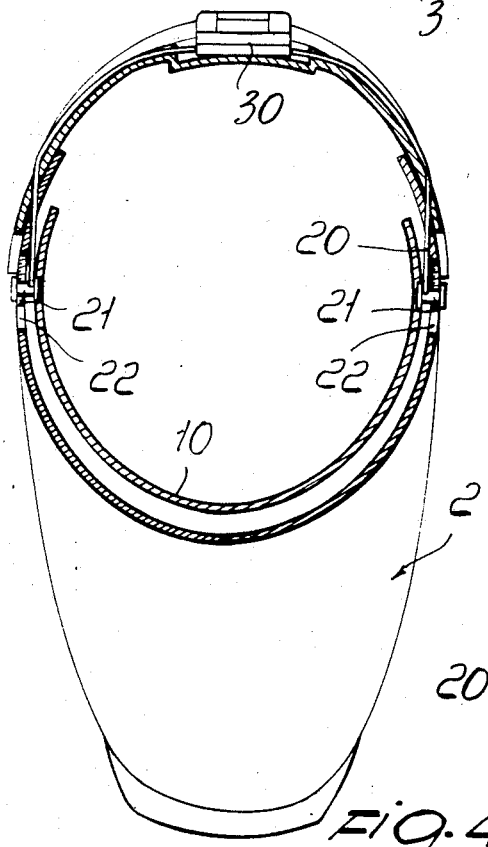
FIG. 4 is a cross section of the ski boot across the quarter showing the closing means.

With reference to said drawing figures, the boot, in particular a ski boot with monolithic structure, according to the invention, which is generally indicated by the reference numeral 1, comprises a body 2 which defines a shell, indicated at 3, and a front quarter 4, expediently monolithically associated therewith.

A rear quarter 5, which closes the rear part of the ski boot, is pivotably coupled towards the rear to the body 2. The front quarter 4 and the rear quarter 5 define a leg area having a front part of the leg area and a rear part of the leg area.

Within said body 2 an internal quarter 10 is provided, which can be manufactured enbloc with the same front quarter or if required can be made as a separate element, as illustrated in the accompanying drawings, and connected to the body 2 substantially at the lower end of same front quarter.

Said internal quarter 10 is shaped in such a manner that it occupies the front part of the leg, the front top part of the foot, as well as lateral portions of the foot.

According to the embodiment illustrated in FIGS. 1 to 6, the internal quarter 10 is associated substantially at the internal front part of body 2 by means of a pin or rivet or similar element indicated at 11.

Figure 7:
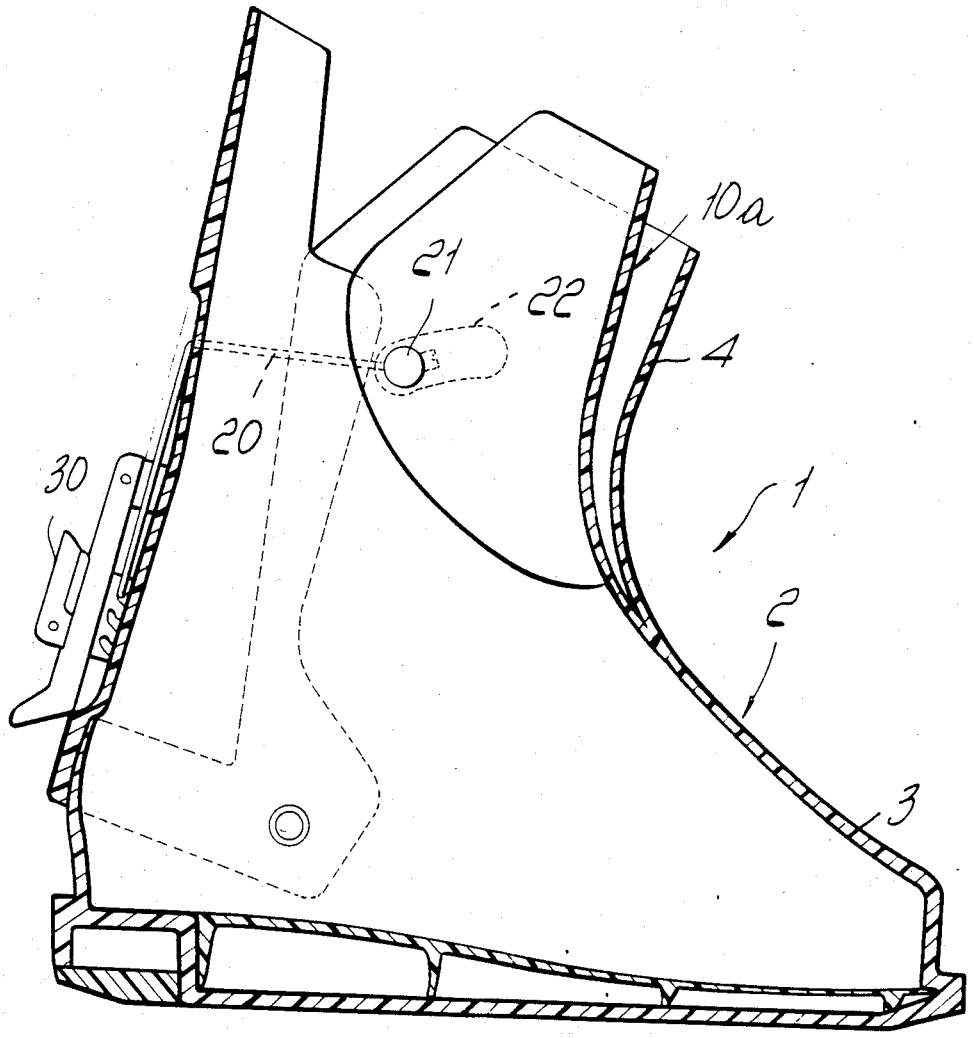
FIG. 7 represents a longitudinal section of the ski boot with an internal quarter occupying the front part of the leg.

As illustrated in FIG. 7, it is also possible to provide an internal quarter 10*a*, made enbloc with body 2 and substantially occupying only the front part of the leg.

Advantageously, the internal quarter 10, which is tiltable is furthermore provided with lateral slots 12 which increase the flexibility thereof, according to contingent requirements.

Between the internal quarters 10 or 10*a* and the front quarter defined by body 2, a space is provided which offers the possibility of a shift of the internal quarter determined by the flexing action of the leg.

In said internal space, indicated at 13, it is possible if required to insert mechanisms or pads with differential structure and resilience, which allow for the possibility of adjusting the flexibility of the ski boot.

Furthermore, the internal space can be used to integrate other accessory elements into the structure, such as, e.g. devices and mechanisms for the adjustment of the fit, for the closing of the toes and/or of the instep of the foot.

In order to perform the closing of the ski boot, according to the invention, closing means are provided acting between the internal quarter 10 or 10*a* and the rear quarter 5, which means, in a preferred embodiment, are composed of an actuating lever mechanism 30 and of a cable 20 the ends of which are connected to small pins 21 rigidly associated with said internal quarter 10 or 10*a*.

The small pins 21 are in turn slideably movable within stroke limits in arc-shaped slots 22 defined by front quarter 4 of body 2, so as to offer the possibility of tilting the internal quarter with respect to the front quarter of body 2, in order to allow for forward flexing during the practice of skiing.

The ski boot further presents the possibility of adjusting the inclination by employing means for positioning the small pins 21 inside the slots 22.

Said means for positioning are composed of a threaded dowel 25, pivotably connected to a threaded seat 26 provided on small pins 21, which pin connects in abutment with the rear end of the slot 22 said rear end constituting limit stop means for the stroke movement of said pins 21 within said slots 22.

By acting upon the threaded dowel 25 it is possible to vary the positioning of the small pins 21 in the slot, in the initial position, consequently varying the inclination.

The cable 20 in turn is connected to the rear quarter, practically encircling it; according to a preferred embodiment, on the rear quarter a lever 30 is provided for the locking of said cable, in order to achieve the closing of the boot.

In practice, in order to perform the closing, one acts on the lever 30, thus shortening the useful length of the cable 20, with the consequent securing of the rear quarter 5 and of the internal quarter on a skier's leg.

Figure 5:
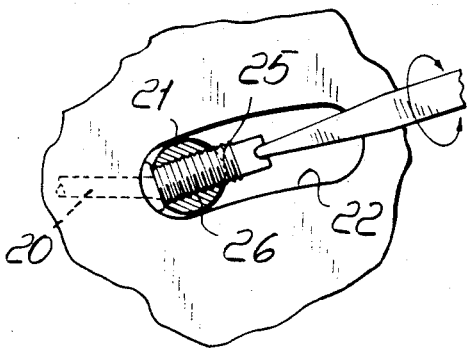
FIGS. 5 and 6 represent the detail of the connection between the closing means and the front quarter, with two different settings.
Figure 6:
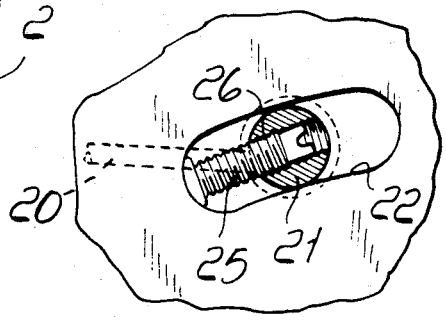
Figure 2:
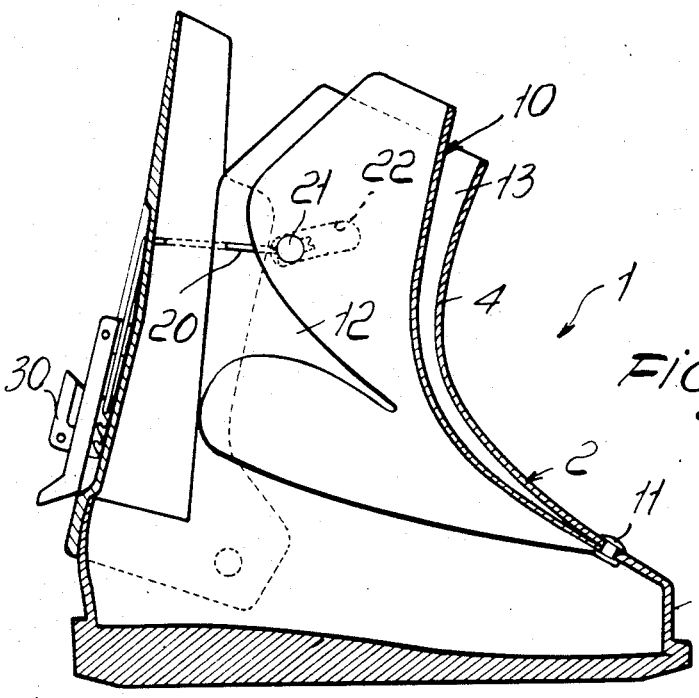
FIGS. 2 and 3 are longitudinal sections of the ski boot in its closed position, with two different settings of the inclination.
Figure 3:
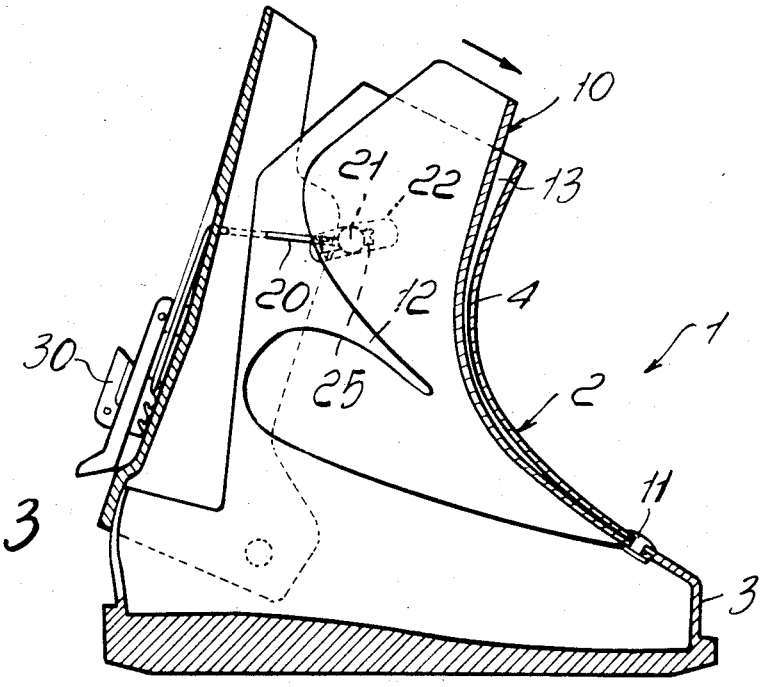

Furthermore, in said securing action the front quarter of the monolithic body 2 is also involved, due to the connection determined by the small pins 21. In fact when the internal quarter is tilted towards said rear quarter beyond a prestablished tilting angle, the front quarter is entrained towards the rear quarter by the engagement of the pins 21 with the rear end of slot 21 as clealry visible in FIGS. 5 and 6 showing the position in which the entrainment action occurs.

Furthermore, there is the possibility of adjusting with extreme ease the inclination of the boot, that is the angle formed by the longitudinal axis of the quarters with a vertical line, by simply acting upon the threaded dowel which shifts the location of the rivets 21 in the slot 22, creating a new location for the rivets.

From what has been described it can be seen that the invention achieves the proposed objects and in particular the fact is stressed that the enbloc manufacture of the shell and of the front quarter allows for the possibility of having a remarkably rigid boot structure especially relatively to lateral stresses, though with reduced thicknesses and consequently reduced weight.

Furthermore, the pecise securing of the skier's leg is accomplished by an internal element, which element's flexibility is easily and quickly adjustable.

The invention thus conceived is susceptible to modifications and variations which are all within the scope of the inventive concept.

Furthermore all the details may be replaced by other technically equivalent elements.

In practice, the materials employed, so long as compatible with the specific use, as well as the dimensions and the contingent shapes, may be any according to the requirements.

I claim:

1. A boot structure of monolithic type comprising, an enbloc body defining a shell portion and a front quarter portion integral therewith, a rear quarter hinged to said shell portion, said front quarter portion and said rear quarter defining a leg area having a front part of the leg area and a rear part of the leg area, a tiltable internal quarter facing internally said front quarter portion and having a lower end portion connected to said body and extending at least over the front part of the leg area, closing means including an actuating mechanism fixed on the rear quarter and transmission means for transmitting the actuating action of said actuating mechanism, wherein said transmission means have at least one end portion thereof fixed to said internal quarter and at least another opposite end portion connected to said rear quarter through said actuating mechanism thereby to tilt said internal quarter towards said rear quarter through a first tilting angle when said actuating mechanism is actuated to close said boot, and wherein said one end portion of said transmission means includes engagement means for slidably engaging within limits said front quarter portion, said front quarter portion having stop means defining said limits of slidable engagement between said engagement means and said front quarter portion, thereby to tighten said front quarter portion towards said rear quarter portion when said closing action on said actuating mechanism is continued beyond said first tilting angle and said engagement means reach said stop means.

2. A boot according to claim 1, wherein said internal quarter is made enbloc with said body and wherein said internal quarter branches internally from said front quarter portion at said front part of said leg area.

3. A boot according to claim 1, wherein said internal quarter includes lateral slots.

4. A boot according to claim 1, wherein said internal quarter defines, in cooperation with said front quarter portion, an internal space for the housing of mechanisms for the adjustment of the boot.

5. A boot according to claim 1, wherein said transmission means comprise at least one cable and wherein said one end portion of said transmission means is a pin connected with said cable and fixed on said tiltable internal quarter, wherein said stop means comprise at least one slot in said front quarter portion, said slot extending in the direction towards said rear quarter and having abutment ends defining said limits of slidable engagement and wherein said engagement means comprise a pin formation projecting from said pin and extending into said slot for slidable engagement within limits therein, said limits defining the length of the stroke performed by said pin formation within said slot.

6. A boot according to claim 5, wherein said pin formation rigid with said tiltable internal quarter has adjustment means for adjusting the length of said stroke defined by the distance between said abutment ends of said slot, one of said abutment ends being nearer to said rear quarter than the other of said abutment ends.

7. A boot according to claim 6, wherein said adjustment means comprise a threaded hole in said pin formation and a threaded dowel rotatably engageable in said threaded hole and in engagement with said one of said abutment ends when said tiltable internal quarter is tilted towards said rear quarter beyond a preestablished tilting angle.

8. A boot structure of monolithic type comprising, an enbloc body defining a shell portion and a front quarter portion integral therewith, a rear quarter hinged to said shell portion, said front quarter portion and said rear quarter defining a leg area having a front part of the leg area and a rear part of the leg area, a tiltable internal quarter facing internally said front quarter portion and having a lower end portion connected to said body and extending at least over the front part of the leg area.

closing means including an actuating lever mechanism fixed on the rear quarter and cable means for transmitting the actuating action of said actuatung lever mechanism, wherein said cable means have at least one end portion thereof fixed to said internal quarter and at least another opposite end portion connected to said rear quarter through said actuating mechanism thereby to tilt said internal quarter towards said rear quarter through a first tilting angle when said actuating mechanism is actuated to close said boot, and wherein said one end portion of said cable means includes a pin structure for slidably engaging within limits said front quarter portion, said front quarter portion having at least one arcuated slot having abutment ends defining limit stop means for determining the stroke extent of slidable engagement portion, thereby to tighten said front quarter portion towards said rear quarter portion when said closing action on said actuating lever mechanism is continued beyond said first tilting angle and said pin structure reaches said stop means.

9. A boot according to claim 8, wherein said pin structure rigid with said tiltable internal quarter has adjustment means for adjusting the length of said stroke extent defined by the distance between said abutment ends of said slot, one of said abutment ends being nearer to said rear quarter than the other of said abutment ends.

10. A boot according to claim 6, wherein said adjustment means comprise a threaded hole in said pin structure and a threaded dowel rotatably engageable in said threaded hole and in engagement with said one of said abutment ends when said tiltable internal quarter is tilted towards said rear quarter beyond a preestablished tilting angle.

* * * * *